United States Patent [19]

Cushing

[11] 4,346,271

[45] Aug. 24, 1982

[54] MANUALLY ACTUATED TIMER FOR APPLIANCES

[75] Inventor: Donald S. Cushing, Louisville, Ky.

[73] Assignee: General Electric Company, Louisville, Ky.

[21] Appl. No.: 194,645

[22] Filed: Oct. 6, 1980

[51] Int. Cl.[3] ..... H01H 43/12

[52] U.S. Cl. ..... 200/38 R; 200/38 A; 200/38 B; 200/153 LB; 200/153 SC

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 153 SC, 153 LA, 153 LB

[56] References Cited

U.S. PATENT DOCUMENTS

| | | | |
|---|---|---|---|
| 3,264,441 | 8/1966 | Jenkins | 200/153 LB |
| 3,789,172 | 1/1974 | Cole et al. | 200/153 SC |
| 3,919,512 | 11/1975 | Ray et al. | 200/153 SC |

*Primary Examiner*—J. V. Truhe
*Assistant Examiner*—Morris Ginsburg
*Attorney, Agent, or Firm*—H. Neil Houser; Radford M. Reams

[57] ABSTRACT

In the illustrative embodiment of the invention, an electromechanical timer employs a manually operable actuator, a pawl and a control cam cooperatively arranged to provide a push to start capability. The control cam is carried on a shaft having a longitudinal bore formed therein. The actuator is slidably received in the bore for axial movement between a neutral position and an actuating position. One end of the actuator extends from the shaft for manual operation. The other end has an axial cam surface formed thereon. The pawl is mounted for pivotal movement between a rest position and a cocked position and spring biased to its rest position. A cam follower extends from the pawl into the path of the axial cam surface of the actuator for camming engagement between pawl and actuator. A ratchet tooth is formed on the control cam for engagement by the pawl. Manual movement of the actuator from its neutral position to its actuating position moves the pawl to its cocked position, thereby storing energy in the biasing spring. Movement of the actuator back to its neutral position releases the pawl. Energy stored in the spring is utilized to drive the pawl to its rest position. In moving from its cocked position to its rest position, the pawl drivingly engages the ratchet tooth formed on the control cam and moves the control cam from its idle position. In moving from its idle position the control cam closes a switch to initiate timer operation.

12 Claims, 8 Drawing Figures

MANUALLY ACTUATED TIMER FOR APPLIANCES

This invention relates to electromechanical timers for appliances and more particularly to electromechanical timers of the push or pull to start type.

BACKGROUND OF THE INVENTION

Electromechanical timers are commonly used in appliances such as dishwashers, washing machines and dryers for controlling the sequential energization and de-energization of electrical components in the appliance to provide the desired cyclical operations. Frequently, such timers require axial movement of the control knob, such as by pushing or pulling the knob. In such timers a control knob mounted for rotation with the control cam-carrying shaft of the timer is manually axially displaced to close a timer motor control switch which is a separate switch provided in addition to the control cam actuated timer switches. Typically, in such arrangements the control knob is retained in its displaced position to maintain motor energization until at or near the end of the operating cycle. Mechanical means are provided to reset the knob to its original position, thereby deactuating the separate switch and ending the cycle.

In some such timers, the timer is deactuated prior to completing a full 360° rotation in order to insure deactuation before the shaft reaches an actuation point so as to prevent repeated cycling. This creates a rotational dead space which is overcome by employing manual rotation of the control knob to an initial position prior to axial displacement.

U.S. Pat. No. 3,264,441 to Jenkins addressed the problem of eliminating the need for manual rotation by providing a push to start arrangement in which the control knob is automatically positioned at the actuation point of the timer at the end of the cycle without perpetual Cycling. As taught by Jenkins, the cycle is started by pushing in the control knob which is mounted to the cam-carrying control shaft to close the separate motor control switch. The knob is held in this position by engagement with the mounting frame, until the end of the cycle at which time an index means mounted to the control shaft becomes aligned with an aperture in the frame permitting axial outward movement of the knob and shaft to its original position, thereby deactuating the motor control switch and terminating the cycle.

Another push to start arrangement known in the art provides for actuation of the separate motor control switch by an axial cam and slider arrangement. In this arrangement, as the control knob is pushed in, an axial cam coupled to the control knob engages a slider and moves it radially outward to actuate the separate switch. The control knob is held in its displaced position by a yielding retaining spring until late in the cycle. At that time, a reset cam surface projecting from the control shaft engages a camming shoulder which urges the shaft outwardly, overcoming the retainer spring and moving of the shaft to its initial, outward position; thereby deactuating the separate switch. In this arrangement one of the cam actuated timer switches is employed as a reset switch in order to maintain continuity during the mechanical reset to assure that the control shaft reset cam has completely cleared the camming shoulder and returned to its initiation point for subsequent actuation. This need for a reset switch is particularly disadvantageous in multicycle appliances since additional switches would likely be required in the selector switch bank to maintain cycle and circuit integrity.

It is therefore an object of the present invention to provide a timer of the type actuated by axial movement of the control knob which eliminates the need for a separate motor control switch, the need for mechanical reset near the end of the operating cycle, and the need for manual rotation of the control knob prior to axial displacement.

It is a further object of the present invention to provide a timer of the aforementioned type which eliminates the need for a reset switch.

It is a further object of the present invention to provide a timer of the aforementioned type for multicycle appliances which eliminates the need for an extra switch or switches in the cycle selector switch bank to maintain cycle and circuit integrity.

It is a further object of the present invention to provide a push to start arrangement in a timer which is relatively simple, inexpensive and reliable.

SUMMARY OF THE INVENTION

In accordance with a preferred embodiment of the present invention, there is provided an electromechanical timer of the push to start type including a control cam carried on a rotatably mounted shaft, a timer motor for rotating the control cam and at least one, and more typically a plurality of cam-actuated control switches, one of which is operative to control energization of the timer motor. The control cam has an idle position in which it operates to deactuate the control switch controlling the energization of the timer motor, thereby preventing energization of the motor. The control cam operates to actuate this switch as the control cam moves from its idle position, thereby enabling energization of the timer motor. The push to start capability is provided by the cooperative arrangement of a manually operable actuator, an engaging member and the control cam.

The actuator is arranged for manual movement between a neutral position and an actuating position and is operative to engage and move the engaging member from a rest position to a cocked position in moving to its actuating position, and to release the engaging member for movement to its rest position as the actuator returns to its neutral position. The engaging member is urged by bias means to its rest position. As the actuator moves the engaging member to its cocked position, energy is stored in the bias means. The engaging member is effective in moving from its cocked position to its rest position to engage and move the control cam from its idle position. Upon release of the engaging member by the actuator, energy stored in the bias means is expended in moving the engaging member to its rest position and consequently the control cam from its idle position. Movement of the control cam from its idle position initiates timer operation by actuating the control switch enabling timer motor energization.

In a preferred form of the invention the control cam is carried on a shaft having a longitudinal bore formed therein. The manually operable actuator is slidably received in the bore for axial movement between its neutral and actuating positions. One end of the actuator extends from the shaft for manual operation and the other end has an axial cam surface formed thereon. The engaging member comprises a pawl mounted for pivotal movement between its rest position and its cocked position and spring biased to its rest position. A cam follower extends from the pawl into the path of the axial cam surface of the actuator for camming engagement between pawl and actuator. A ratchet tooth is formed on the control cam for engagement by the pawl. Manual movement of the actuator from its neutral position to its actuating position moves the pawl to its cocked position, thereby storing energy in the biasing spring. Movement of the actuator back to its neutral position releases the pawl, permitting the spring to drive the pawl to its rest position. In moving from its cocked position to its rest position, the pawl drivingly engages the ratchet tooth formed on the control cam and energy stored in the spring is utilized to move the control cam from its idle position, thereby closing the switch and enabling energization of the timer motor to initiate timer operation.

The subject matter regarded as comprising the present invention is particularly pointed out and distinctly claimed in the concluding portion of this specification. However, the invention both as to organization and manner of operation may be best understood by reference to the following description taken in conjunction with the accompanying drawings.

DETAILED DESCRIPTION OF THE INVENTION

Figure 1:
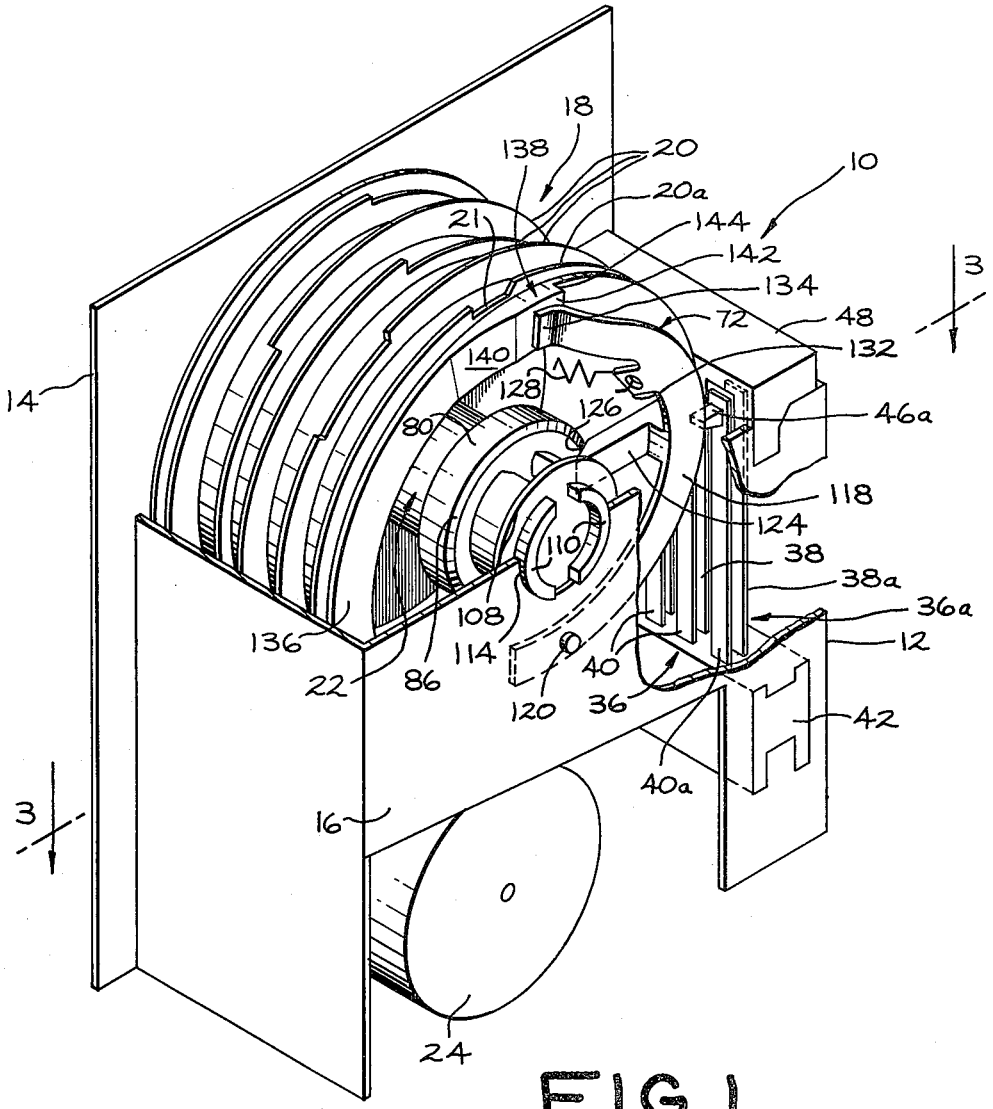
FIG. 1 is a perspective view with portions cut away of a timer illustratively embodying the present invention.

Referring now to FIG. 1, structural support for timer 10 is primarily provided by frame 12 including a front plate 14 and a rear plate 16. A control cam 18 having a plurality of control cam surfaces 20 on its periphery is formed integrally with a control cam-carrying shaft 22 which is rotatably mounted to frame 12. Control cam 18 is rotatably driven by driving means comprising a conventional timer motor 24 coupled to control cam 18 by a chain of gears 26, 28, 30, 32 and 34 (shown in phantom in FIG. 4) in a conventional manner well known in the art.

A plurality of cam actuated control switches designated generally 36 are suitably secured to frame 12. Each one of switches 36 comprises a pair of contact arms 38 and 40 extending from terminal block 42 for actuation by control cam 18. Each arm carries an electrical contact 44. Contact arm 40 of each pair engages a corresponding switch cam follower **46*a* which is slidably supported for horizontal movement in support block 48 and extends therefrom for tracking a corresponding one of the control cam surfaces 20. Each contact arm 40 biases its corresponding cam follower 46*a* against its corresponding control cam surface 20. Control cam surfaces 20** are contoured to provide the desired sequential switch actuation in a conventional manner.

Figure 4:
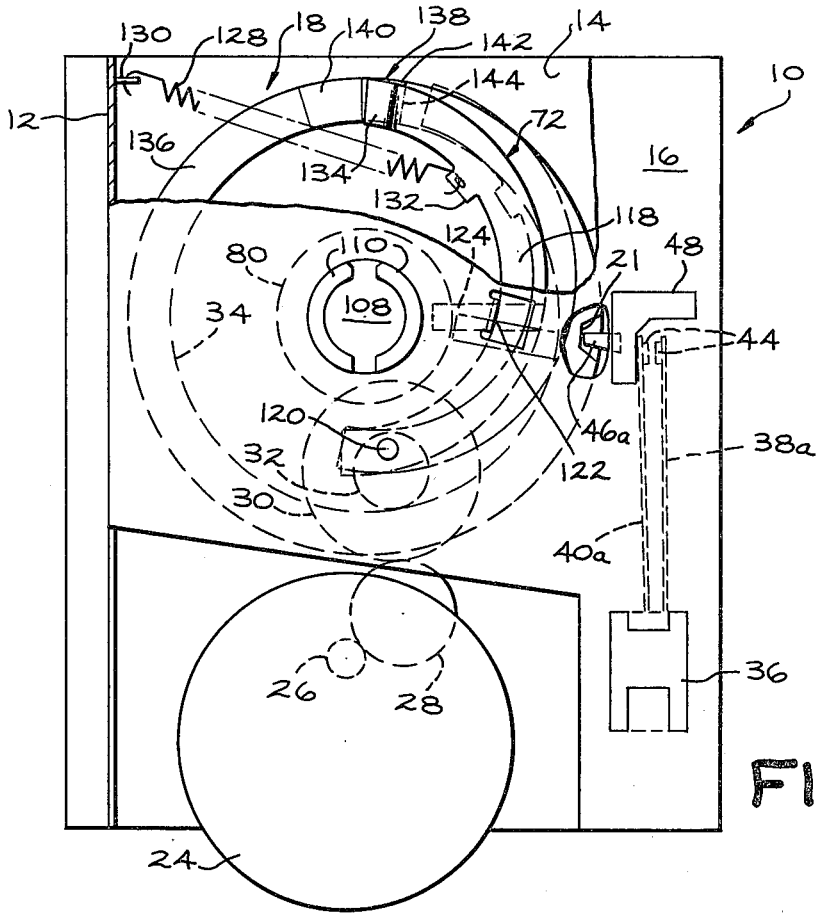
FIG. 4 is a plan view with portions cut away of the timer of FIG. 1 showing different operating positions.
Figure 5:
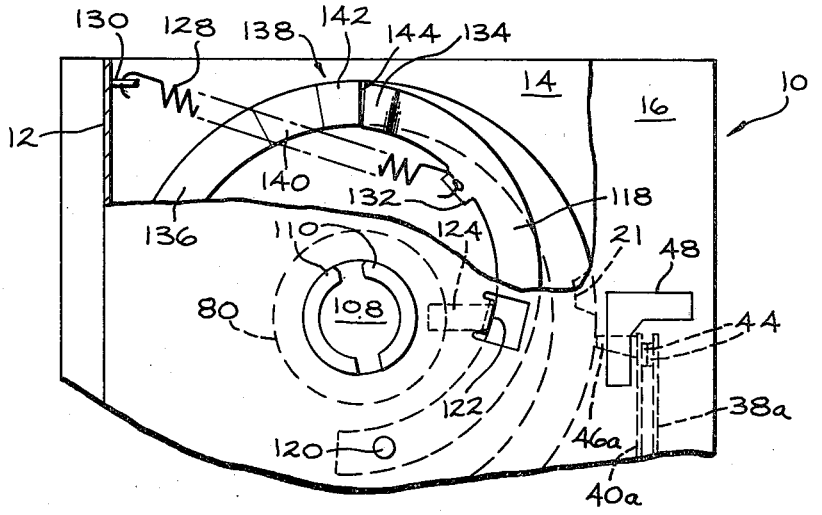
FIG. 5 is a partial plan view with portions cut away of the timer of FIG. 1 showing the timer immediately following actuation.

The particular one of switches 36 designated **36*a* in FIGS. 1, 4 and 5, which includes contact arms 38*a* and 40*a*, is connected in electrical series with timer motor 24 such that when actuated, energization of timer motor 24 is enabled and when deactuated the circuit is open, preventing energization of the motor. The particular ones of control surfaces 20 and cam followers 46*a* associated with switch 36*a* are designated 20*a* and 46*a*, respectively. Control surface 20*a* includes a notch 21 which when aligned with cam follower 46*a* causes deactuation of switch 36*a***.

While for purposes of illustration a control cam is employed as the rotating member in the illustrative embodiment to actuate the control switches, it is to be understood that other alternative arrangements for operatively coupling a rotating control member with the switches to provide sequential switch actuation by rotation of the rotating member could be employed. Also, the number of switches controlled by the rotating member is a matter of design choice typically determined by the number of components to be controlled by the timer.

Figure 3:
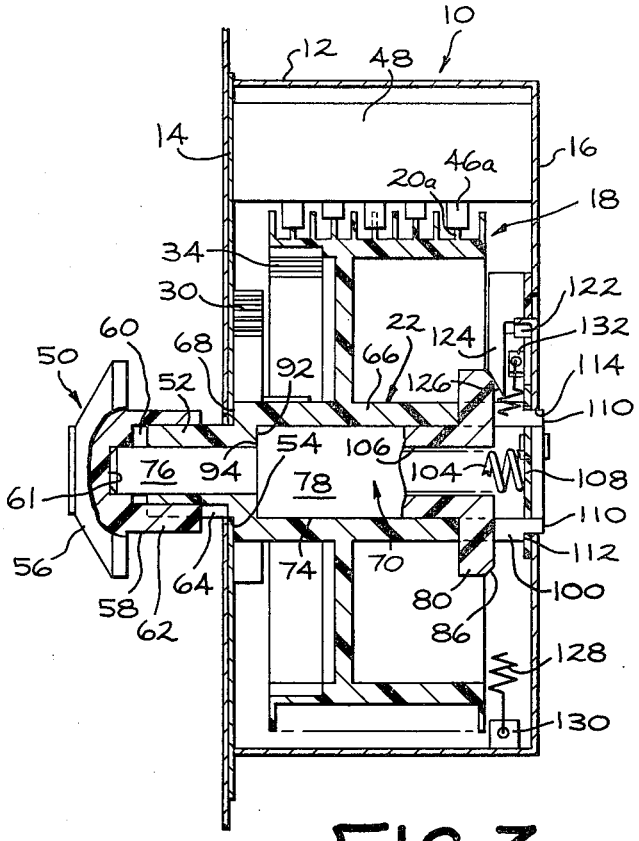
FIG. 3 is a cross-sectional view of the timer of FIG. 1 taken along lines 3—3.
Figure 2:
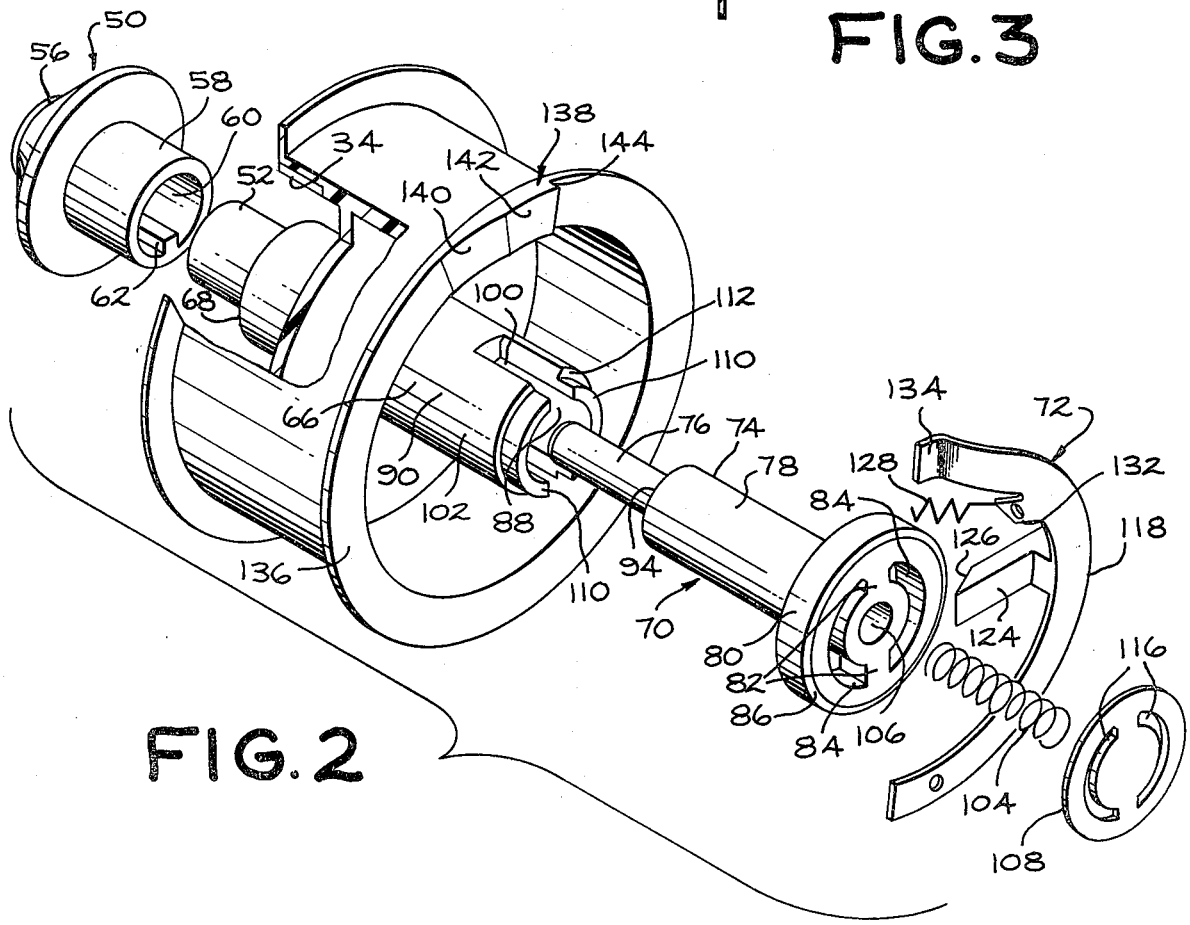
FIG. 2 is an exploded perspective view of a subassembly of the timer of FIG. 1.

Referring now to FIGS. 2 and 3, timer 10 has a control knob 50 for user manipulation which enables a user to manually rotate the control cam 18 and also to actuate timer 10 to initate cycle operation by axial movement of the knob.

Control knob 50 is slidably mounted on the external end 52 of cam-carrying shaft 22 which projects from frame 12 through aperture 54 in front plate 14.

Control knob 50 includes a knob or handle portion 56 and a cylindrical mounting portion 58. Cylindrical mounting portion 58 has formed therein a blind bore 60 terminated by end wall 61 and adapted to fit over the external end 52 of cam-carrying shaft 22. Cylindrical portion 58 is loosely fit to external end portion 52 to permit axial movement of knob 50 relative to shaft 22. An axially extending, inwardly projecting key 62 is formed in bore 60 for engagement with a key slot 64 formed in external end portion 52 to cause shaft 22 and knob 50 to rotate together.

Axial movement of control knob 50 is translated into rotational movement of control cam 18 by the mechanical interaction of control knob 50, an actuator 70 and an engaging member 72 of the control cam.

Figure 7:
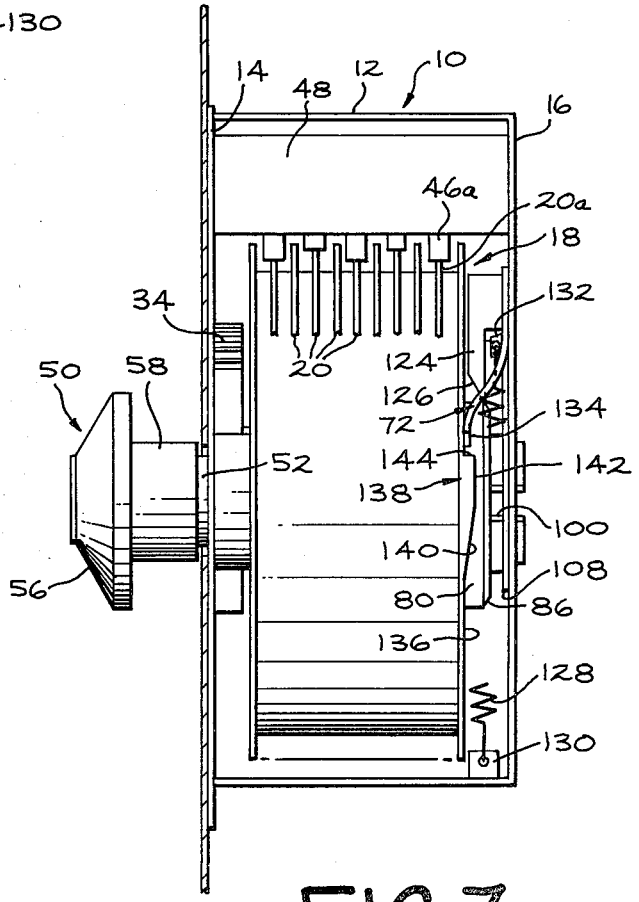
FIG. 7 shows the timer of FIG. 6 with the actuator moved to its actuating position and the engaging member in its cocked position.

Actuator 70 is a generally cylindrical member axially movable between a neutral position shown in FIG. 3 in which the acutator is fully outwardly extended relative to frame 12 and an actuating position shown in FIG. 7, in which actuator 70 is in its innermost position relative to frame 12.

Actuator 70 includes an elongated portion 74 comprising external end portion 76 of reduced diameter and central portion 78 and an internal annular ring member 80 of enlarged diameter. Ring portion 80 is joined to elongated portion 74 at its internal end by radially extending web members 82, forming segmented annular spaces or apertures 84 between ring member 80 and elongated portion 74. An axial cam surface 86 is formed at the periphery of ring member 80 generally facing rear plate 16.

Actuator 70 is slidably mounted for axial movement relative to shaft 22. To this end, the elongated portion of actuator 70 is slidably received in a bore 88 formed in shaft 22, with the internal end 90 of shaft 22 passing through apertures 84 in ring portion 80. Bore 88 runs longitudinally through the length of shaft 22 and is of stepped diameter forming a shoulder 92 to accommodate the stepped outer diameter of actuator 70. Shoulder 92 in bore 88 abuttingly engages shoulder 94 formed on actuator 70 at the intersection of end portion 76 and central portion 78, to limit further outward movement of actuator 70.

External end portion 76 of actuator 70 projects from external end portion 52 of shaft 22 for press fit engagement within aperture 60 of control knob 50. By this arrangement, actuator 70 moves axially in response to axial movement of control knob 50.

Shaft 22 is rotatably supported in frame 12 by insertion of external end portion 52 in aperture 54 in front plate 14 and internal end portion 90 in aperture 114 in rear plate 16. End portion 52 of shaft 22 is of reduced diameter relative to the central portion 66 of the shaft. A shoulder 68 formed on shaft 22 at the intersection of external end portion 52 and central portion 66 abuttingly engages plate 14 to limit outward movement (to the left as seen in FIG. 3) of shaft 22.

The interior end portion 90 of shaft 22 passes through ring portion 80 of actuator 70 for mounting engagement with plate 16. Two longitudinally running diametrically opposed slots 100 are formed in internal end portion 90. Slots 100 divide the interior end portion of shaft 22 into annular segments 102 conforming to spaces 84 formed in ring member 80. Segments 102 are slidably received in spaces 84 permitting passage of shaft 22 through ring member 80 and permitting axial movement of actuator 70 relative to shaft 22. As segments 102 pass through spaces 84, web members 82 are received in slots 100, keying actuator 70 to shaft 22 for rotation in concert therewith.

Segments 102 include end extensions 110 of reduced diameter extending from a shoulder 112. Extensions 110 are received in an aperture 114 formed in rear plate 16 to provide rotational support for shaft 22.

Actuator 70 is biased toward its neutral position in shaft 22 by compression spring 104. A longitudinal blind bore 106 is formed in elongated portion 74 of actuator 70 to receive compression spring 104. A spring stop member 108 is interposed between actuator 70 and rear plate 16 to retain compression spring 104 in bore 106. Spring stop member 108 includes segmented annular slots 116 axially aligned with slots 84 but of reduced outer diameter, permitting extensions 110 of shaft 22 to pass through. The outer periphery of stop member 108 abuttingly engages shoulder 112 of shaft 22 to limit movement of shaft 22 to the right, as seen in FIG. 3.

In the illustrative embodiment, the engaging member 72 is in the form of a pawl comprising an arcuate lever arm 118 pivotally mounted near one end to rear plate 16 of frame 12 by pin 120. Pawl 72 is mounted for pivotal movement between a rest position, shown in full lines in FIG. 4, with arm 118 abuttingly engaging a stop or flange 122 projecting inwardly from rear plate 16; and a cocked position pivoted clockwise from its rest position as shown in broken lines in FIG. 4. A cam follower 124, integrally formed with lever arm 118, extends radially inwardly therefrom. A sloped cam surface 126 formed on cam follower 124 extends into the axial path of actuator 70 for camming engagement with axial cam surface 86. As actuator 70 moves from its neutral position to its actuating position, axial cam surface 86 of actuator 70 cammingly engages sloped cam surface 126 of cam follower 124, thereby moving cam follower 124 radially outwardly, pivoting pawl 72 from its rest position to its cocked position.

Pawl 72 is biased toward its rest position by a tension spring 128, connected at one end to tab 130 on frame 12 and at the other end to tab 132 on pawl 72. As pawl 72 is pivoted to its cocked position by actuator 70, spring 128 is stretched, thereby storing energy in the spring. As actuator 70 moves from its actuating position to its neutral position, releasing pawl 72 for movement to its rest position, the energy stored in spring 128 is utilized to move pawl 72 to its rest position.

Pawl 72 further comprises at its other end an engaging tip 134, which rides on side wall 136 of control cam 18. Spring 128 in addition to biasing pawl 72 to its rest position also biases engaging tip 134 against side wall 136. A ratchet tooth 138 is formed on side wall 136, extending axially therefrom. Tooth 138 comprises a sloping portion or ramp 140 which rises to a raised flat portion 142. Flat portion 142 drops off to form a tooth shoulder 144. Tooth 138 is positioned on control cam 18 relative to notch 21 in control surface **20*a* which defines the cam's idle position such that when control cam 18 is in its idle position, tooth 138 is positioned for engagement with pawl 72. As best seen in FIG. 4, showing control cam 18 in its idle position with notch 21 aligned with switch cam follower 46*a*, engaging tip 134 rests on tooth 138 near the intersection of ramp 140 and flat portion 142 above tooth 144. As pawl 72 pivots clockwise to its cocked position, engaging tip 134 rides over tooth 138 and drops down to side wall 136 to the right of tooth shoulder 144, as seen in phantom in FIG. 4. As pawl 72 returns to its rest position, engaging tip 134 rides along side wall 136 in a counterclockwise direction and drivingly engages tooth shoulder 144 and carries tooth shoulder 144, thereby rotating control cam 18 counterclockwise away from its idle position. FIG. 5 shows pawl 72 returned to its rest position with engaging tip 134 engaging tooth shoulder 144. By this arrangement, pawl 72 interacts with ratchet tooth 138 as a ratchet and pawl combination to rotate control cam 18 from its idle position in response to manual operation of actuator 70**.

Figure 8:
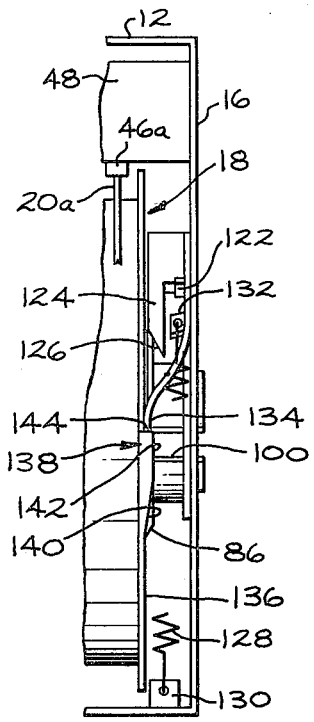
FIG. 8 shows a portion of the timer of FIG. 6 illustrating the engaging member approaching its rest position in driving engagement with the control cam in moving the control cam from its idle position.
Figure 6:
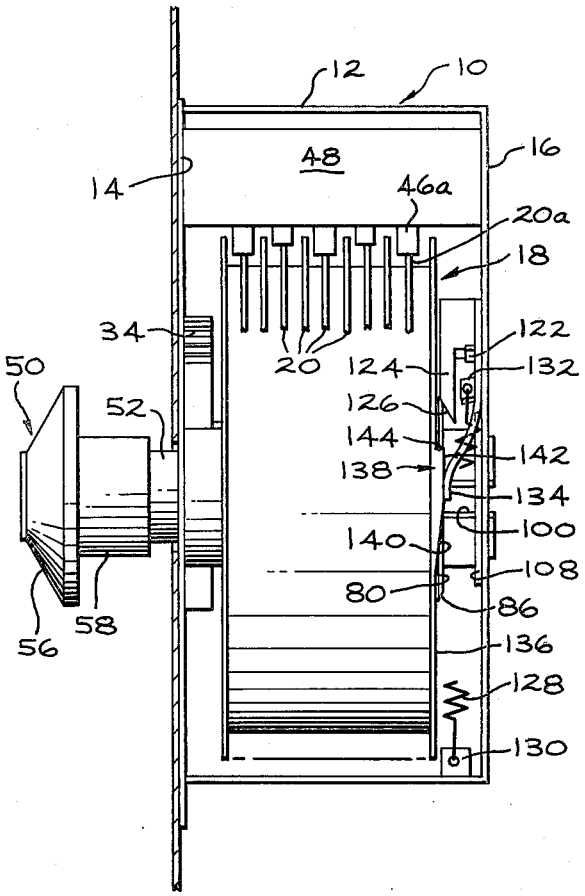
FIG. 6 is a top elevational view of the timer of FIG. 1 illustrating the control cam in its idle position, engaging member in its rest position, and the actuator in its neutral position.

Push to start operation of the timer will now be described with reference to FIGS. 6–8. FIG. 6 shows timer 10 in its deactuated position with actuator 70 fully outwardly extended in its neutral position, control cam 18 in its idle position and pawl 72 in its rest position with engaging tip 134 resting at the intersection of ramp 140 and flat portion 142 of ratchet tooth 138. In this state, notch 21 in control cam surface **20*a* is aligned with cam follower 46*a* of switch 36*a* so that switch 36*a*** is deactuated, preventing timer motor energization.

To initiate timer operation, the operator manually pushes control knob 50 from its outward position shown in FIG. 6 to its inward position shown in FIG. 7. This moves actuator 70 from its neutral position to its actuating position. In moving to its actuating position, axial cam surface 86 of actuator 70 cammingly engages cam follower 124 of pawl 72, pivoting pawl 72 to its cocked position. As pawl 72 moves to its cocked position, engaging tip 134 drops below tooth shoulder 144 and rides on side wall 136 with spring 128 extended. Control cam 18 remains in its idle position.

To complete the push to start operation, the operator merely releases control knob 50. Bias spring 104 then returns actuator 70 and control knob 50 to the neutral position. As actuator 70 returns to its neutral position, cam follower 124 of pawl 72 is released, permitting movement of pawl 72 to its rest position. Spring 128 drives pawl 72 back to its rest position, causing engaging tip 134 to drivingly engage tooth shoulder 144. Energy stored in spring 128 is utilized to move control cam 18 from its rest position as engaging tip 134 carries tooth shoulder 144 as it returns to its rest position as shown in FIG. 8.

As control cam 18 moves from its idle position, notch 21 in control surface 20*a* is moved out of alignment with switch cam follower 46*a*, causing cam surface 20*a* to actuate switch 36*a* and complete the electrical circuit connecting timer motor 24 to an external power supply, thereby enabling energization of timer motor 24 and initiating the operating cycle. Once timer motor 24 is energized by moving control cam 18 from its idle position, motor 24 continues to rotate control cam 18 in a counterclockwise direction, as seen in FIG. 4, until control cam 18 returns to its idle position. At that time notch 21 again moves into alignment with cam switch cam follower 46*a* and switch 36*a* is deactuated. The timer remains in its idle position awaiting subsequent push to start actuation.

In the illustrative embodiment hereinbefore described, each cycle involves one complete revolution of the control cam and, consequently, the control cam has one idle position and one correspondingly positioned ratchet tooth. However, the present invention can be advantageously employed in timers of the multiple cycle type in which more than one operating cycle is provided by each full rotation of the control cam.

In such timers, an idle position is provided for each cycle. A push to start capability for initiating each cycle can be provided in accordance with the present invention by modifying the control cam to have a corresponding idle position for each cycle and adapting it to be engageable in each idle position by the engaging member as the engaging member moves from its cocked position to its rest position.

The illustrative embodiment described hereinbefore can be modified to accommodate such an arrangement by providing a notch in control surface 20*a* of the type exemplified by notch 21 at the location desired for each idle position, and a corresponding ratchet tooth, as exemplified by tooth 138, for each idle position positioned on side wall 136 of the control cam relative to its corresponding idle position defining notch in the same manner as tooth 138 is positioned relative to notch 21. Accordingly, at the end of each cycle, the control cam assumes the idle position corresponding to that cycle. In that position, the corresponding notch in control surface 20*a* will be aligned with switch cam follower 46*a*. In this position, the corresponding ratchet tooth will be positioned for engagement by engaging tip 134 of pawl 72. The control cam can then be rotated to initiate the next cycle by the same push to start operation described for the illustrative embodiment.

While in accordance with the patent statutes I have illustrated and described a specific embodiment of my invention, it is realized that numerous modifications and changes will occur to those skilled in the art. It is therefore to be understood that the appended claims are intended to cover all such modifications and changes as fall within the true spirit and scope of the invention.

I claim:

1. An electromechanical timer for use in washing appliances comprising:

a frame;

a control cam rotatably mounted to said frame and having an idle position;

an electrically energizable motor for rotating said control cam;

control switch means for controlling energization of said motor, said switch means being operative when de-actuated to prevent energization of said motor and when actuated to enable energization of said motor; said control cam being operative in its idle position to de-actuate said switch means and in moving from its idle position to actuate said switch means;

an engaging member mounted to said frame for movement between a cocked position and a rest position and bias means urging said engaging member toward its rest position;

said engaging member being effective to move said control cam from its idle position as said engaging member moves from its cocked position to its rest position;

a manually operable actuator mounted to said frame for movement between an actuating position and a neutral position; said actuator being operative to engage and move said engaging member to its cocked position as said actuator moves from its neutral position to its actuating position and to release said engaging member for movement to its rest position as said actuator moves from its actuating position to its neutral position; whereby the sequential movement of said actuator from its neutral position to its actuating position and back to its neutral position causes said control cam to move from its idle position to thereby enable energization of said motor.

2. A timer in accordance with claim 1 wherein said actuator includes a cam portion, said control cam has a ratchet tooth formed thereon, and said engaging member comprises a pawl pivotably mounted to said frame, said pawl having a cam follower disposed in the path of said cam portion of said actuator; said actuator being operative by camming engagement of said cam portion and said cam follower to move said pawl to its cocked position as said actuator moves to its actuating position and to permit movement of said pawl to its rest position as said actuator moves to its neutral position, said pawl being operative in moving from its cocked position to its rest position to drivingly engage said ratchet tooth when said control cam is in its idle position and to move said control cam from its idle position.

3. A timer in accordance with claim 2 further comprising a hollow shaft rotatably mounted to said frame and wherein said control cam is secured to said shaft for rotation therewith and said actuator includes an elongated portion extending from said cam portion, said elongated portion being slidably received in said hollow shaft permitting axial movement of said actuator between its actuating position and its neutral position and projecting externally from said shaft for manual operation.

4. A timer in accordance with claim 3 further comprising means disposed within said hollow shaft for biasing said actuator toward its neutral position.

5. A push-to-start electromechanical timer comprising:

a frame;

a hollow cam carrying shaft rotatably mounted to said frame;

a generally cylindrical control cam mounted on said shaft for rotation therewith and having an idle position, said control cam having formed on its periphery a plurality of control cam surfaces;

a motor for rotating said control cam, adapted for energization by an external power supply and operative when energized to rotate said control cam;

a plurality of control switches arranged for sequential actuation by said plurality of control cam surfaces, one of said switches being operative when actuated to enable energization of said motor and when deactuated to prevent energization of said motor; one of said plurality of control cam surfaces being operative to deactuate said one switch when said control cam is in its idle position and to actuate said one switch when said control cam moves from its idle position;

a manually operable actuator slidably received in said hollow shaft for axial movement between an actuating position and a neutral position, said actuator including an external end extending from said shaft for manual operation and an internal end forming an axial cam surface;

pawl means mounted to said frame for pivotal movement between a cocked position and a rest position, said pawl means including a cam follower disposed in the path of said axial cam surface for camming engagement therewith;

bias means for urging said pawl means toward its rest position;

a ratchet tooth formed on said control cam for engagement by said pawl means;

said axial cam surface being operative by camming engagement with said cam follower to move said pawl means to its cocked position as said actuator moves from its neutral position to its actuating position, and to release said pawl means as said actuator returns to its neutral position; said pawl means being operative in moving from its cocked position to its rest position to engage said ratchet tooth when said control cam is in its idle position and carry said ratchet tooth as said pawl means returns to its rest position thereby moving said control cam from its idle position, whereby said one control switch is actuated enabling energization of said motor and initiating timer operation.

6. An electromechanical timer comprising:

a mounting frame;

a cam carrying shaft rotatably mounted to said frame, said shaft having a longitudinal bore formed therein;

a control cam secured to said shaft for rotation therewith; said control cam having an initiating position and a terminating position;

an electrically energizable motor for rotating said control cam from its initiating position to its terminating position;

at least one control switch operated by said control cam, said control switch being operative when deactuated to prevent energization of said motor and when actuated to permit energization of said motor, said control cam being operative in its terminating position to de-actuate said control switch and in its initiating position to actuate said control switch;

an actuator slidably disposed in said bore of said cam carrying shaft for axial movement between an actuating position and a neutral position;

engaging means responsive to said actuator constructed and arranged to engage and rotate said control cam from its terminating position to its initiating position, said engaging means being placed in driving engagement with said control cam in its terminating position by said actuator in moving to its actuating position and said engaging means being operative to move said control cam to its initiating position as said actuator moves to its neutral position, whereby timer operation is initiated by the sequential movement of said actuator from its neutral position to its actuating position and back to its neutral position.

7. A timer in accordance with claim 6 wherein said engaging means includes spring means operative to receive and store energy in response to movement of said actuator from its neutral position to its actuating position, and to release its stored energy for moving said control cam to its initiating position as said actuator returns to its neutral position.

8. A timer in accordance with claim 7 wherein said engaging means further includes pawl means pivotally mounted to said frame for movement between a cocked position and a rest position and operative in moving from its cocked position to its rest position to drivingly engage said control cam in its terminating position and move said control cam to its initiating position, said actuator being operative to move said pawl means to its cocked position in moving to its actuating position, and permitting said pawl means to move to its rest position in moving to its neutral position; said spring means biasing said pawl means toward its rest position, such that said spring means stores energy as said pawl means moves to its cocked position and releases its stored energy in moving said pawl to its rest position.

9. An electromechanical timer for use in controlling the sequential operation of a washing appliance comprising:

a frame;

a control cam rotatably mounted to said frame and having an idle position;

an electrically energizable motor for rotating said control cam;

a plurality of control switches mounted to said frame for sequential actuation by said control cam;

one of said plurality of control switches being operative when actuated to enable energization of said motor and when de-actuated and to prevent energization of said motor; said control cam being operative in its idle position to de-actuate said one switch, and operative to actuate said one switch in moving from its idle position;

an engaging member mounted to said frame for movement between a cocked position and a rest position; said engaging member being effective to move said control cam from its idle position as said engaging member moves from its cocked position to its rest position;

bias means urging said engaging member toward its rest position;

a manually operable actuator mounted to said frame for movement between an actuating position and a neutral position; said actuator being operative to engage and move said engaging member to its cocked position as said actuator moves to its actuating position and to release said engaging member for movement to its rest position as said actuator moves from its actuating position to its neutral position, whereby the sequential movement of said actuator from its neutral position to its actuating position and back to its neutral position causes said control cam to move from its idle position to enable energization of said motor.

10. An electromechanical timer in accordance with claim 9 further comprising a cam carrying shaft having a longitudinal bore formed therein, rotatably mounted to said frame and wherein said control cam is mounted to said shaft for rotation therewith, said actuator is slidably received in said bore for axial movement between its actuating position and its neutral position; said engaging member comprises pawl means pivotally mounted to said frame for movement between said cocked position and said rest position; and said control cam has formed thereon a ratchet tooth, said pawl means being operative in moving from its cocked position to its rest position to drivingly engage and move said ratchet tooth thereby moving said control cam from its idle position.

11. An electromechanical timer in accordance with claim 10 wherein said actuator has formed thereon an axial cam surface and said pawl means includes a cam follower disposed in the path of said axial cam surface for camming engagement therewith; said actuator being operative by camming engagement with said cam follower to move said pawl means to its cocked position as said actuator moves from its neutral position to its actuating position.

12. An electromechanical timer in accordance with claim 11 wherein said bias means comprises spring means operative to store energy as said pawl means moves to its cocked position and to release said stored energy in moving said pawl means to its rest position.

* * * * *